US007827967B2

(12) United States Patent
Beardmore

(10) Patent No.: US 7,827,967 B2
(45) Date of Patent: Nov. 9, 2010

(54) LOW NOISE FUEL PUMP WITH VARIABLE PRESSURE REGULATION

(75) Inventor: John M. Beardmore, Howell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 89 days.

(21) Appl. No.: 12/256,511

(22) Filed: Oct. 23, 2008

(65) Prior Publication Data

US 2010/0101538 A1 Apr. 29, 2010

(51) Int. Cl.
*F02M 37/04* (2006.01)
*F02M 37/08* (2006.01)

(52) U.S. Cl. ..... 123/506; 123/503

(58) Field of Classification Search ..... 123/495, 123/503, 496, 500, 501, 504, 508, 506
See application file for complete search history.

(56) References Cited

U.S. PATENT DOCUMENTS 5,529,042 A * 6/1996 Augustin et al. ..... 123/456
6,135,090 A * 10/2000 Kawachi et al. ..... 123/446
6,523,526 B2 * 2/2003 Schwarz ..... 123/506
2006/0000446 A1 * 1/2006 Ricco et al. ..... 123/446
2009/0065292 A1 3/2009 Beardmore et al.
2009/0068041 A1 3/2009 Beardmore

* cited by examiner

*Primary Examiner*—Mahmoud Gimie
(74) *Attorney, Agent, or Firm*—Harness, Dickey & Pierce, P.L.C.

(57) ABSTRACT

An engine assembly may include an engine structure defining a combustion chamber, a fuel injector in fluid communication with the combustion chamber, a fuel supply and a fuel pump assembly. The fuel pump assembly may include a housing, a reciprocating member, and a solenoid valve assembly. The housing may define an inlet in fluid communication with the fuel supply, an outlet in fluid communication with the fuel injector, and a bypass passage. The reciprocating member may be located within the housing to define a compression chamber in fluid communication with the inlet, the outlet, and the bypass passage. The solenoid valve assembly may include a valve member located within the bypass passage and displaceable between open and closed positions to selectively provide fluid communication between the compression chamber and the fuel supply during a compression stroke of the reciprocating member.

20 Claims, 3 Drawing Sheets

LOW NOISE FUEL PUMP WITH VARIABLE PRESSURE REGULATION

FIELD

The present disclosure relates to engine fuel systems, and more specifically to controlling pressure in engine fuel injection systems.

BACKGROUND

This section provides background information related to the present disclosure which is not necessarily prior art.

Engine fuel systems may include a fuel pump assembly having an inlet valve controlling an amount of fuel supplied to a compression chamber of a fuel pump. The pump may be in the form of a reciprocating pump and the inlet valve may include a solenoid valve. During a maximum fuel delivery mode, the inlet valve may be closed during an entirety of a compression stroke of the pump. However, during reduced fuel demand conditions, fuel pressure supplied by the pump may be controlled based on timing a closing of the inlet valve during the compression stroke of the pump.

For example, the inlet valve may remain open during a first portion of the compression stroke and may be closed at a point during the compression stroke to provide a desired fuel pressure output. However, the timing of the valve closing may generate an abrupt rise in pressure within the compression chamber, resulting in undesirable noise in the fuel system.

SUMMARY

This section provides a general summary of the disclosure, and is not a comprehensive disclosure of its full scope or all of its features.

An engine assembly may include an engine structure defining a combustion chamber, a fuel injector in fluid communication with the combustion chamber, a fuel supply and a fuel pump assembly. The fuel pump assembly may include a housing, a reciprocating member, and a solenoid valve assembly. The housing may define an inlet in fluid communication with the fuel supply, an outlet in fluid communication with the fuel injector, and a bypass passage. The reciprocating member may be located within the housing to define a compression chamber in fluid communication with the inlet, the outlet, and the bypass passage. The solenoid valve assembly may include a valve member located within the bypass passage and displaceable between open and closed positions to selectively provide fluid communication between the compression chamber and the fuel supply during a compression stroke of the reciprocating member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
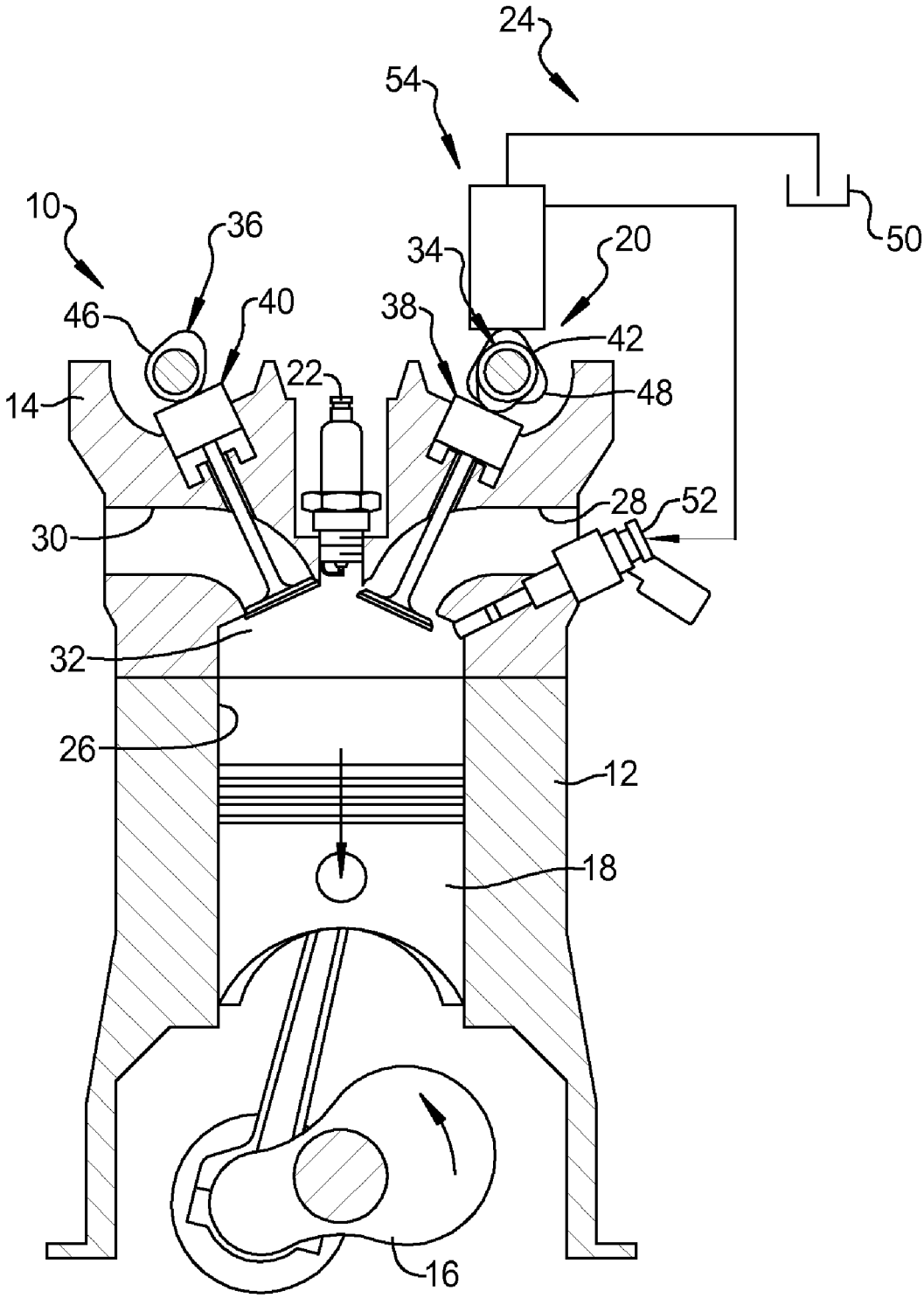
FIG. 1 is a schematic illustration of an engine assembly according to the present disclosure.

As seen in FIG. 1, an engine assembly 10 may include an engine block 12, a cylinder head 14, a crankshaft 16, pistons 18 (one of which is shown), a valvetrain assembly 20, a spark plug 22, and a fuel system 24. The engine block 12 may define cylinder bores 26 (one of which is shown) each having a piston 18 disposed therein. It is understood that the present teachings apply to any number of piston-cylinder arrangements and a variety of engine configurations including, but not limited to, V-engines, inline engines, and horizontally opposed engines, as well as both overhead cam and cam-in-block configurations.

The cylinder head 14 may include intake and exhaust passages 28, 30. The engine block 12, cylinder head 14, and piston 18 may cooperate to define a combustion chamber 32. The valvetrain assembly 20 may be supported by the cylinder head 14 and may include intake and exhaust camshafts 34, 36 and intake and exhaust valve assemblies 38, 40. The intake camshaft 34 may include a lobe 42 engaged with the intake valve assembly 38 and the exhaust camshaft 36 may include a lobe 46 engaged with the exhaust valve assembly 40. An additional lobe member 48 may be included on the intake camshaft 34 for engagement with the fuel system 24, as discussed below. While the lobe member 48 is shown on the intake camshaft 34, it is understood that the lobe member 48 may alternatively be part of the exhaust camshaft 36 or part of a separate fuel pump drive shaft (not shown). Alternatively, an accessory drive belt may be used to drive the fuel pump. Further, it is understood that a single camshaft may include both the intake and exhaust lobes 42, 46, as well as the additional lobe member 48. The lobe member 48 may include any number of lobes appropriate for operation of the fuel system 24. By way of non-limiting example, the lobe member 48 may include a two, three or four lobe arrangement.

The fuel system 24 may include a fuel tank 50, a fuel injector 52, and a fuel pump assembly 54. The fuel tank 50 may be in fluid communication with the fuel pump assembly 54. The fuel injector 52 may extend into, and therefore be in fluid communication with, the combustion chamber 32 forming a direct injection configuration. The fuel injector 52 may receive a pressurized fuel supply from the fuel pump assembly 54.

Figure 2:
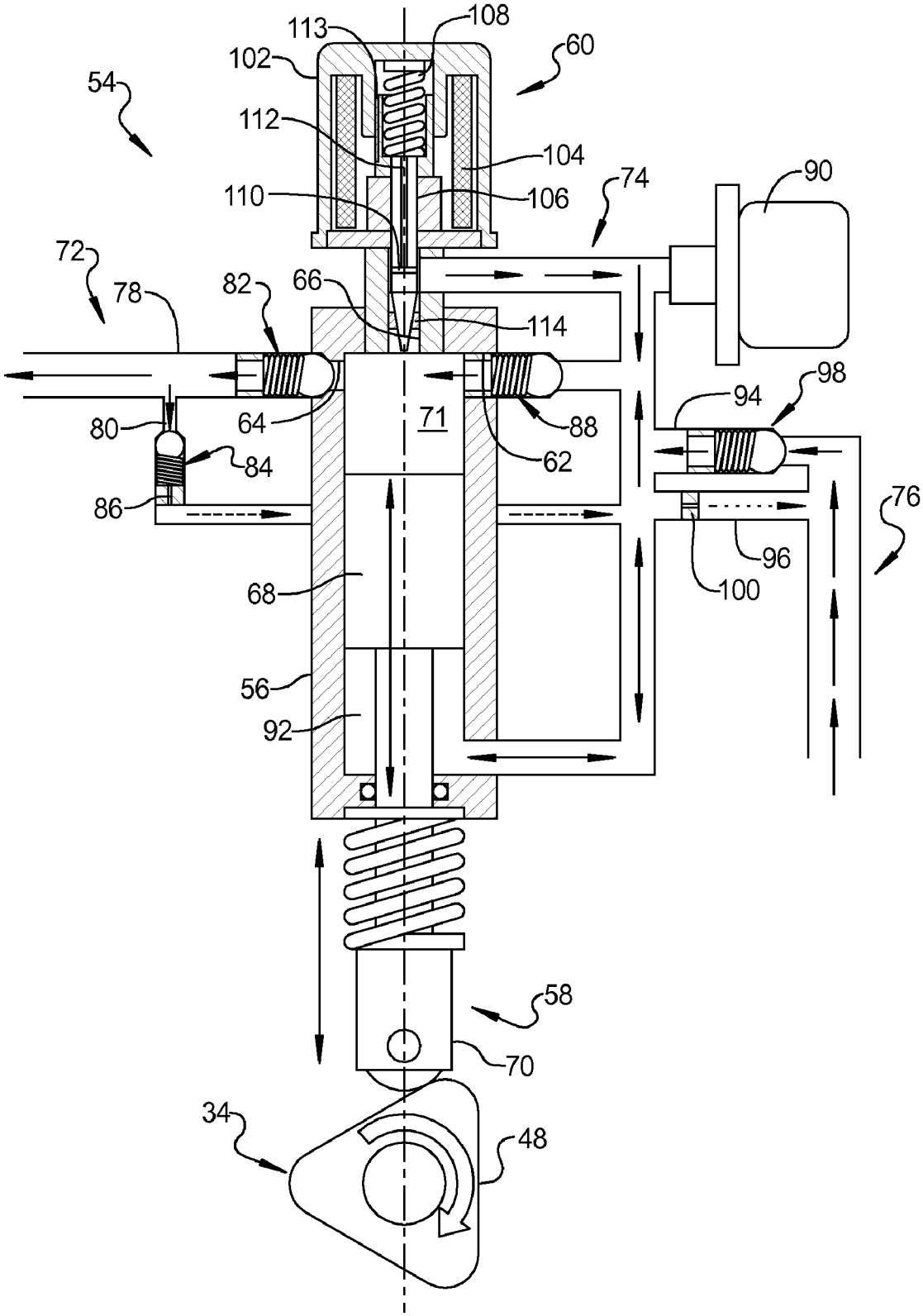
FIG. 2 is a schematic illustration of a first fuel system according to the present disclosure.

With reference to FIG. 2, the fuel pump assembly 54 may include a housing 56, a reciprocating member 58, and a solenoid valve assembly 60. The housing 56 may include a housing inlet 62, a housing outlet 64, and a bypass passage 66. The reciprocating member 58 may include a plunger 68 located within the housing 56 and a cam follower 70 extending from the housing 56 and engaged with the additional lobe member 48 on the intake camshaft 34. The plunger 68 may cooperate with the housing 56 to form a compression chamber 71. The housing inlet 62, the housing outlet 64, and the bypass passage 66 may each be in fluid communication with the compression chamber 71.

The fuel pump assembly 54 may further include a high pressure passage 72, a low pressure passage 74, and a supply passage 76. The high pressure passage 72 may include first and second portions 78, 80. The first portion 78 may provide fluid communication between the housing outlet 64 and the fuel injector 52. The second portion 80 may form a relief passage providing fluid communication between the first portion 78 of the high pressure passage 72 and the low pressure passage 74. A first valve assembly 82 may be located in the first portion 78 and may selectively provide fluid communication between the compression chamber 71 and the fuel injector 52 via the housing outlet 64. A second valve assembly 84 may be located in the second portion 80 to selectively provide fluid communication between the high pressure passage 72 and the low pressure passage 74. The first and second valve assemblies 82, 84 may each include mechanical valve assemblies having a valve member and spring arrangement normally biased to a closed position (shown in FIG. 2). By way of non-limiting example, the first and second valve assemblies 82, 84 may each be in the form of a one-way valve and the valve member may include a ball or disc. The second valve assembly 84 may additionally include a restriction 86, such as an orifice, to limit flow when the second valve assembly 84 is in the open position.

The fuel tank 50, the low pressure passage 74 and the supply passage 76 may generally form a fuel supply for the compression chamber 71. The low pressure passage 74 may provide fluid communication between the supply passage 76 and the compression chamber 71. A third valve assembly 88 may be located in the low pressure passage 74 to selectively provide fluid communication between the low pressure passage 74 and the compression chamber 71. The third valve assembly 88 may also include a mechanical valve assembly having a valve member and spring arrangement and may be normally biased to a closed position (shown in FIG. 2). By way of non-limiting example, the third valve assembly 88 may also form a one-way valve and the valve member may include a ball or disc. The low pressure passage 74 may additionally be in fluid communication with the solenoid valve assembly 60, an accumulator 90 and a low pressure chamber 92 in the housing 56 located beneath the plunger 68. The accumulator 90 may reduce a pressure pulsation generated by the plunger 68. By way of non-limiting example, the accumulator 90 may include a pulse accumulator such as a fluid volume, a spring-loaded piston device, a diaphragm accumulator, or a waffle absorber.

The supply passage 76 may provide fluid communication between the fuel tank 50 and the low pressure passage 74. While not shown, it is understood that the fuel supply may include a fuel pump to supply fuel to the supply passage 76. The supply passage 76 may include first and second portions 94, 96 in fluid communication with the low pressure passage 74. The first and second portions 94, 96 may control a fuel flow to the low pressure passage 74. A fourth valve assembly 98 may be located in the first portion 94 to selectively provide fluid communication between the supply passage 76 and the low pressure passage 74. The fourth valve assembly 98 may also include a mechanical valve assembly having a valve member and spring arrangement and may be normally biased to a closed position (shown in FIG. 2). By way of non-limiting example, the fourth valve assembly 98 may also form a one-way valve and the valve member may include a ball or disc. A restriction 100, such as an orifice, may be located in the second portion 96 to limit a fuel flow returning to the supply passage 76 and reduce a pressure pulsation from the plunger 68 returning to the supply passage 76.

The solenoid valve assembly 60 may selectively provide fluid communication between the compression chamber 71 and the low pressure passage 74 via the bypass passage 66. The solenoid valve assembly 60 may ultimately control a fuel pressure supplied to the fuel injector 52 and may include a housing 102, a solenoid coil 104, a valve member 106, a biasing member 108, and a seat 114. The biasing member 108 may include a coil spring and may normally bias the valve member 106 into a closed position (shown in FIG. 2) preventing fluid communication between the compression chamber 71 and the low pressure passage 74 via the bypass passage 66. The solenoid coil 104 may be selectively energized to displace the valve member 106 against the force of the biasing member 108 to provide fluid communication between the compression chamber 71 and the low pressure passage 74 via the bypass passage 66. By way of non-limiting example, the solenoid valve assembly 60 may form a force motor where the valve member 106 is displaced in proportion to the electromagnetic field (EMF) produced in the solenoid coil 104 (balanced against the biasing member 108) as controlled by a pulse width modulated (PWM) signal.

The valve member 106 may include first, second, and third fluid passages 110, 112, 113. When the valve member 106 is in the closed position, the fluid passages 110, 112, 113 may be in fluid communication with the low pressure passage 74. The fluid passages 110, 112, 113 may provide for exposure of the interior of the housing 102 to fuel from the low pressure passage 74 and may additionally provide pressure balancing for the valve member 106. The passages 110, 112, 113 may provide approximately equal exposure of opposite axial end portions of the valve member 106 to fuel pressure from the low pressure passage 74, eliminating the need for complicated seals and limiting any additional bias on the valve member 106. An end of the valve member 106 may engage the seat 114 when the valve member 106 is in the closed position. The seat 114 may be located within the bypass passage 66 and may include a tapered surface engaged with a tapered surface at the end of the valve member 106. Displacement of the valve member 106 from the seat 114 may create a variable opening (or orifice) providing controlled communication between the compression chamber 71 and the low pressure passage via bypass passage 66.

During engine operation, fuel may be supplied to the compression chamber 71 via the supply passage 76. During a downward (or suction) stroke of the plunger 68, fuel may be drawn into the compression chamber 71. Specifically, the pressure within the compression chamber 71 during the suction stroke may be less than the fuel pressure in the low pressure passage 74, resulting in the third valve assembly 88 being displaced to an open position allowing fuel flow from the supply passage 76 to the compression chamber 71. The valve member 106 of the solenoid valve assembly 60 may be in the closed position during an entirety of the suction stroke during some or all engine operating conditions. For example, the valve member 106 may be in the closed position during an entirety of the suction stroke during a maximum fuel delivery mode.

During the upward (or compression) stroke of the plunger 68, fuel pressure within the compression chamber 71 may increase. The increase in fuel pressure within the compression chamber may cause the third valve assembly 88 to close, preventing fluid communication between the compression chamber 71 and the low pressure passage 74 via the housing inlet 62. The compressed fuel may be discharged through the housing outlet 64, passing through the first valve assembly 82. The first valve assembly 82 may be opened based on a pressure within the compression chamber 71 during the compression stroke. The pressurized fuel may be provided to the fuel injector 52. The second valve assembly 84 may control a maximum fuel pressure supplied to the fuel injector 52. Excess fuel may be returned to the low pressure passage 74 by the second portion 80 of the high pressure passage 72 through the second valve assembly 84 when a fuel pressure limit in the high pressure passage 72 is exceeded.

During a maximum fuel delivery mode, the solenoid valve assembly 60 may be in a closed position to prevent fluid communication between the compression chamber 71 and the low pressure passage 74 via the bypass passage 66. Therefore, during the maximum fuel delivery mode, the compression chamber 71 may be isolated from the low pressure passage 74 during an entirety of the compression stroke. However, fuel demand may vary based on engine operating conditions.

During reduced fuel demand conditions, the solenoid valve assembly 60 may be displaced to an open position where the bypass passage 66 is in fluid communication with the low pressure passage 74 during the compression stroke of the plunger 68. The valve member 106 may be displaced to provide a variable restriction (or orifice) between the compression chamber 71 and the low pressure passage 74 to provide a controlled leak path therebetween. The controlled leak path may be adjusted using the valve member 106 to provide a desired fuel pressure to the high pressure passage 72, and therefore to the fuel injector 52.

More specifically, during reduced fuel demand conditions, pressurized fuel may flow from the compression chamber 71 to the high pressure passage 72 via the housing outlet 64 and from the compression chamber 71 to the low pressure passage 74 via the bypass passage 66. The valve member 106 may be displaced a predetermined amount to provide a controlled leak path during an entirety of the compression stroke when the fuel pump assembly 54 is operated during reduced fuel demand conditions. This generally continuous leak path may reduce pressure pulsations typically generated during reduced fuel demand conditions. The amount of bypass flow may generally control a fuel pressure provided to the fuel injector 52.

Pressure pulsations created by the bypass flow in the low pressure passage 74 during the compression stroke may be absorbed by the accumulator 90. Pressure pulsations created by the fuel displaced from the low pressure chamber 92 during the suction stroke may be absorbed by the accumulator 90 as well. The transmission of pressure pulsations generated in the low pressure passage 74 during either of the compression or the suction strokes to the supply passage 76 may be further limited by combination of the fourth valve assembly 98 and the restriction 100. The fourth valve assembly 98 may prevent flow from the low pressure passage 74 to the supply passage 76 through the first portion 94 of the supply passage 76, forcing the backflow through the restriction 100 in the second portion 96 of the supply passage 76.

Figure 3:
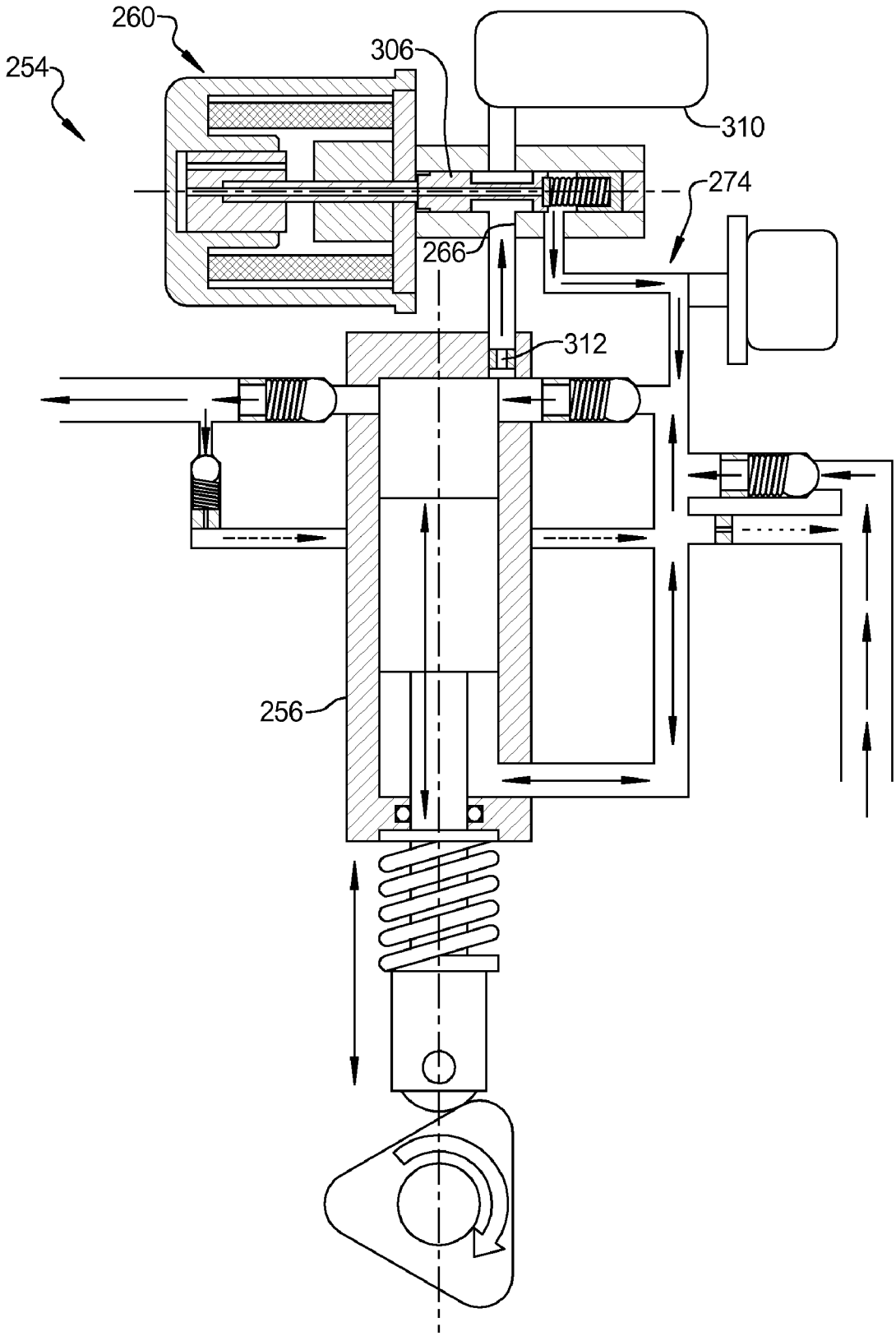
FIG. 3 is a schematic illustration of a second fuel system according to the present disclosure.

An alternate fuel pump assembly 254 is illustrated in FIG. 3. The fuel pump assembly 254 may be generally similar to the fuel pump assembly 54, with the exception of the solenoid valve assembly 260. The solenoid valve assembly 260 shown in FIG. 3 may include a valve member 306 in the form of a spool valve and may selectively provide fluid communication between the bypass passage 266 in the housing 256 in a manner similar to the valve member 106 of FIG. 2. The solenoid valve assembly 260 may further include an additional accumulator 310 in fluid communication with the bypass passage 266 and a restriction 312, such as an orifice, may be located in the bypass passage 266 to further limit pressure pulsations transferred to the low pressure passage 274.

What is claimed is:

1. An engine assembly comprising:

an engine structure defining a combustion chamber;

a fuel injector in fluid communication with the combustion chamber;

a fuel supply; and a fuel pump assembly including a housing, a reciprocating member, and a solenoid valve assembly, the housing defining an inlet in fluid communication with the fuel supply, an outlet in fluid communication with the fuel injector, and a bypass passage, the reciprocating member being located within the housing to define a compression chamber in fluid communication with the inlet, the outlet, and the bypass passage, the solenoid valve assembly including a valve member located within the bypass passage and displaceable between open and closed positions to selectively provide fluid communication between the compression chamber and the fuel supply during a compression stroke of the reciprocating member, the valve member being in the open position during an entirety of a compression stroke of the reciprocating member to provide a controlled leak path between the compression chamber and the fuel supply through the bypass passage.

2. The engine assembly of claim 1, wherein the fuel pump assembly includes a first inlet valve assembly located between the fuel supply and the compression chamber, the first inlet valve assembly being displaceable between an open position and a closed position, the first inlet valve assembly providing fluid communication between the compression chamber and the fuel supply when in the open position and isolating the compression chamber from fluid communication with the fuel supply when in the closed position.

3. The engine assembly of claim 2, wherein the first inlet valve assembly is maintained in the closed position during a compression stroke of the reciprocating member.

4. The engine assembly of claim 2, wherein the first inlet valve assembly includes a mechanical valve displaceable between the open and closed positions based on a pressure within the compression chamber.

5. The engine assembly of claim 4, wherein the mechanical valve is maintained in the closed position during compression strokes of the reciprocating member due to a fuel pressure within the compression chamber being greater than a fuel pressure in the fuel supply.

6. The engine assembly of claim 2, wherein the fuel pump assembly includes an outlet valve assembly located between the fuel injector and the compression chamber, the outlet valve assembly being displaceable between an open position and a closed position, the outlet valve assembly providing fluid communication between the compression chamber and the fuel injector when in the open position and isolating the fuel injector from fluid communication with the compression chamber when in the closed position.

7. The engine assembly of claim 6, wherein the fuel pump assembly includes a relief valve assembly located between the outlet valve assembly and the fuel injector, the relief valve assembly being displaceable between an open position and a closed position, the relief valve assembly providing fluid communication between a pressurized fuel feed to the fuel injector and the fuel supply when in the open position and isolating the pressurized fuel feed from fluid communication with the fuel supply when in the closed position.

8. The engine assembly of claim 1, wherein the valve member is in the closed position during an entirety of a suction stroke of the reciprocating member.

9. The engine assembly of claim 1, wherein the fuel supply includes a fuel tank and the fuel pump assembly includes first and second flow paths in fluid communication with the fuel tank, a fuel supply valve being located in the first flow path and preventing fuel flow from the compression chamber to the fuel tank through the first flow path, and a restriction member being located in the second flow path and limiting fuel flow from the compression chamber to the fuel tank through the second flow path.

10. The engine assembly of claim 1, wherein the valve member is in the closed position during the compression stroke of the reciprocating member during a maximum fuel demand condition, the valve member being in the open position during the entirety of a compression stroke during a reduced fuel demand condition relative to the maximum fuel demand condition.

11. A fuel pump assembly comprising:

a housing defining an inlet in fluid communication with a fuel supply, an outlet in fluid communication with a fuel injector, and a bypass passage in fluid communication with the fuel supply;

a reciprocating member located within the housing to define a compression chamber in fluid communication with the inlet, the outlet, and the bypass passage; and a solenoid valve assembly including a valve member located within the bypass passage and displaceable between open and closed positions to selectively provide fluid communication between the compression chamber and the fuel supply during a compression stroke of the reciprocating member, the valve member being in the open position during an entirety of a compression stroke of the reciprocating member to provide a controlled leak path between the compression chamber and the fuel supply through the bypass passage.

12. The fuel pump assembly of claim 11, further comprising a first inlet valve assembly located between the fuel supply and the compression chamber, the first inlet valve assembly being displaceable between an open position and a closed position, the first inlet valve assembly providing fluid communication between the compression chamber and the fuel supply when in the open position and isolating the compression chamber from fluid communication with the fuel supply when in the closed position.

13. The fuel pump assembly of claim 12, wherein the first inlet valve assembly is maintained in the closed position during a compression stroke of the reciprocating member.

14. The fuel pump assembly of claim 12, wherein the first inlet valve assembly includes a mechanical valve displaceable between the open and closed positions based on a pressure within the compression chamber.

15. The fuel pump assembly of claim 14, wherein the mechanical valve is maintained in the closed position during compression strokes of the reciprocating member due to a fuel pressure within the compression chamber being greater than a fuel pressure in the fuel supply.

16. The fuel pump assembly of claim 12, further comprising an outlet valve assembly located between the fuel injector and the compression chamber, the outlet valve assembly being displaceable between an open position and a closed position, the outlet valve assembly providing fluid communication between the compression chamber and the fuel injector when in the open position and isolating the fuel injector from fluid communication with the compression chamber when in the closed position.

17. The fuel pump assembly of claim 16, further comprising a relief valve assembly located between the outlet valve assembly and the fuel injector, the relief valve assembly being displaceable between an open position and a closed position, the relief valve assembly providing fluid communication between a pressurized fuel feed to the fuel injector and the fuel supply when in the open position and isolating the pressurized fuel feed from fluid communication with the fuel supply when in the closed position.

18. The fuel pump assembly of claim 11, wherein the valve member is in the closed position during an entirety of a suction stroke of the reciprocating member.

19. The fuel pump assembly of claim 11, wherein the fuel supply includes a fuel tank and the fuel pump assembly includes first and second flow paths in fluid communication with the fuel tank, a fuel supply valve being located in the first flow path and preventing fuel flow from the compression chamber to the fuel tank through the first flow path, and a restriction member being located in the second flow path and limiting fuel flow from the compression chamber to the fuel tank through the second flow path.

20. The fuel pump assembly of claim 11, wherein the valve member is in the closed position during the compression stroke of the reciprocating member during a maximum fuel demand condition, the valve member being in the open position during the entirety of a compression stroke during a reduced fuel demand condition relative to the maximum fuel demand condition.

* * * * *